US006779497B2

(12) United States Patent
Maisch

(10) Patent No.: US 6,779,497 B2
(45) Date of Patent: Aug. 24, 2004

(54) VALVE STROKE CONTROL FOR INTERNAL COMBUSTION ENGINES OF MOTOR VEHICLES

(75) Inventor: Dieter Maisch, Kohlberg (DE)

(73) Assignee: Hydraulik-Ring GmbH, Nürtingen (DE)

( * ) Notice: Subject to any disclaimer, the term of this patent is extended or adjusted under 35 U.S.C. 154(b) by 0 days.

(21) Appl. No.: 10/249,805

(22) Filed: May 9, 2003

(65) Prior Publication Data

US 2003/0209215 A1 Nov. 13, 2003

(30) Foreign Application Priority Data

May 10, 2002 (DE) ..... 102 20 692

(51) Int. Cl.[7] ..... F01L 1/34

(52) U.S. Cl. ..... 123/90.16; 123/90.44; 123/90.46

(58) Field of Search ..... 123/90.16, 90.15, 123/90.44, 90.45, 90.46

(56) References Cited

U.S. PATENT DOCUMENTS 4,231,543 A * 11/1980 Zurner et al. ..... 251/57
5,829,397 A * 11/1998 Vorih et al. ..... 123/90.12
6,293,237 B1 * 9/2001 Vorih ..... 123/90.12

* cited by examiner

*Primary Examiner*—Thomas Denion
*Assistant Examiner*—Zelalem Eshete
(74) *Attorney, Agent, or Firm*—Gudrun E. Huckett

(57) ABSTRACT

A valve stroke control for an internal combustion engine of a motor vehicle has a control device for adjusting a valve stroke. It interacts with a camshaft and a control shaft. The control device is actuated by a hydraulic medium and has a first control element and a second control element movable relative to one another. The first control element is sleeve-shaped and the second control element is received in the first control element. A rocker lever is acted on by the camshaft. The first control element is supported on the rocker lever and the second control element is supported on the control shaft.

23 Claims, 7 Drawing Sheets

VALVE STROKE CONTROL FOR INTERNAL COMBUSTION ENGINES OF MOTOR VEHICLES

BACKGROUND OF INVENTION

1. Field of the Invention

The invention relates to a valve stroke control for internal combustion engines of motor vehicles, comprising at least one control device provided for adjusting the stroke of valves, wherein the at least one control device interacts with at least one camshaft and at least one control shaft.

2. Description of the Related Art

By means of valve stroke controls, the valves of an internal combustion engine of motor vehicles are opened only to such an extent that the required fuel quantity for the respective output demand of the engine is injected into the combustion chamber. The control shaft acts on a control element in the form of a lever which acts on the valve shaft. This mechanical control element is prone to failure and does not enable a precise adjustment of the valve stroke.

SUMMARY OF INVENTION

It is an object of the present invention to configured the valve stroke control of the aforementioned kind such that the valve stroke can be adjusted precisely and reliably in a constructively simple way.

In accordance with the present invention, this is achieved in that the control device is actuated by a hydraulic medium.

The control device is thus hydraulically actuated in accordance with the present invention, and, since the hydraulic medium is present within a motor vehicle anyway, the control device can be supplied easily with the required hydraulic medium. By means of the control device the stroke of the valve can be adjusted simply and precisely.

DETAILED DESCRIPTION

Figure 1:
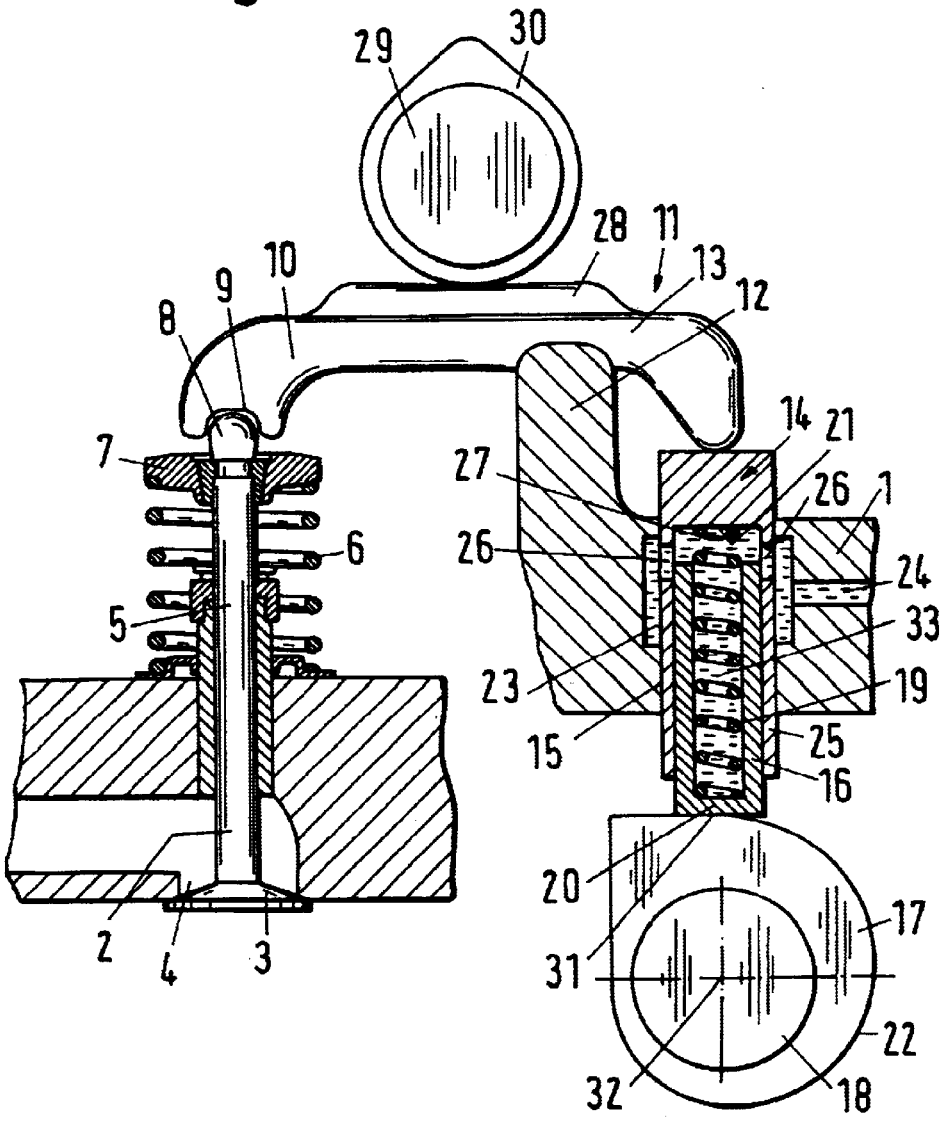
FIG. 1 illustrates a first adjusting position of a first embodiment of a valve stroke control of the present invention in connection with an overhead camshaft.

The valve stroke control described in the following is designed to control or change the stroke of valves in internal combustion engines preferably in a variable way. FIG. 1 shows a cylinder head 1 of an internal combustion engine in which, depending on the engine type, a different number of combustion chambers and corresponding valves 2 are provided. In FIG. 1, one of these valves 2 is illustrated. It is provided with a valve disk 3 with which an intake opening

4 into the combustion chamber can be closed. The valve disk 3 is mounted on the end of a valve shaft 5 which can be moved counter to the force of at least one pressure spring 6 into an open position. At the end of the valve shaft 5 opposite the valve disk 3, a spring plate 7 is provided. The end of the pressure spring 6 is supported on the valve plate 7. The other end of the spring 6 is supported on the cylinder head. In this way, the valve disk 3 is pulled by the pressure spring 6 into the closed position illustrated in FIG. 1.

The end 8 of the valve shaft 5 projecting past the spring plate 7 is spherical and positioned in a cup-shaped receptacle 9 provided at the free end of an arm 10 of a two-arm rocker lever 11. The rocker lever 11 is secured transversely to an imaginary pivot axis in a fork member 12 provided on the cylinder head 1. The other arm 13 of the rocker lever 11 rests against an adjusting cylinder 14 which is slidably mounted in a bore 15 in the cylinder head 1. The adjusting cylinder 14 receives a hollow piston 16 resting against a cam 17 of a control shaft 18. The hollow piston 16 receives at least one pressure spring 19 which is supported with one end on the bottom 20 of the hollow piston 16 and with the other end on a bottom 21 of the adjusting cylinder 14. The hollow piston 16 is loaded by the pressure spring 19 always such that its bottom 20 rests at all times against a control curve 22 of the cam 17 of the control shaft 18. The hollow piston 16 is slidably and sealingly guided within the adjusting cylinder 14. Since the hollow piston 16 receives the pressure spring 19, a very compact configuration results.

When sufficient mounting space is available, the part 16 can also be of a solid construction. In this case, a greater size of the control device results because the pressure spring 19 is positioned between the end face of the part 16 and the bottom 21 of the adjusting cylinder 14.

The adjusting cylinder 14 is surrounded about a portion of its length by an annular chamber 23 provided within the cylinder head 1. A bore 24 opens into the annular chamber 23. The annular chamber 23 is formed by a section of the bore 15 which has a widened diameter.

The adjusting cylinder 14 has penetrations 26 that are arranged in the cylinder wall 25 at a minimal spacing from its bottom 21 and are distributed about the circumference. The penetrations 26 are preferably in the form of bores providing connections by means of which the annular chamber 23 is connected with the interior 27 of the adjusting cylinder 14.

The two ends of the lever arms 10, 13 are angled in a direction toward the valve shaft 5 and the adjusting cylinder 14, respectively. On the opposed side, the rocker lever 11 is provided with a projection or raised portion 28 which extends across most of the length of the rocker lever 11 and against which a camshaft 29 rests. By means of the projection 28 the rocker lever 11 is pivoted for opening the valve 2 in a way to be described in the following.

The rocker lever 11 is not fixedly supported but rests with the ends of its arms 10, 13 against the valve shaft 5 and against the adjusting cylinder 14.

FIG. 1 shows the initial position of the valve control in which the cam 30 of the camshaft 29 is not engaged by the rocker lever 11. The control shaft 18 is rotated into a position in which a contact area 31 between the control curve 22 and the bottom 20 of the hollow piston 16 has the greatest spacing relative to the axis 32 of the control shaft 18. In this position, the valve 2 is closed. The hollow piston 16 has a spacing from the bottom 21 of the adjusting cylinder 14 whose penetrations (bores) 26 connect the annular chamber 23 with the interior 27 of the adjusting cylinder 14 as well as with the interior 33 of the hollow piston 16.

When the camshaft 29 is rotated in the direction of arrow 34 (FIG. 2), the cam 30 reaches the area of the arm 13 the rocker lever 11. The lever 11 is thus moved in the clockwise direction thereby moving the adjusting cylinder 14 against the force of the pressure spring 19. Since the control shaft 18 is not rotated, the hollow piston 16 is supported on the control curve 22 of the cam 17 of the control shaft 18. The adjusting cylinder 14 is moved to such an extent on the hollow piston 16 that the penetrations (bores) 26 in the cylinder wall 25 of the adjusting cylinder 14 are closed by the hollow piston 16. In this way, the connection between the interiors 27, 33 of the adjusting cylinder 14 and of the hollow piston 16 is closed relative to the annular chamber 23. The hydraulic medium which is contained in both interiors 27, 33 is in this way enclosed so that the adjusting cylinder 14 cannot be moved relative to the hollow piston 16. As long as the penetrations/bores 26 of the adjusting cylinder 14 are not yet closed, the hydraulic medium is displaced out of the interiors 27, 33 via the penetrations (bores) 26 and the annular chamber 23 back into the bore 24 when the adjusting cylinder 14 is moved, and in this way the hydraulic medium is returned into the hydraulic medium circulation.

As soon as the bores 26 are closed by the hollow piston 16, the adjusting cylinder 14 and the hollow piston 16 act as a fixed bearing for the rocker lever 11.

Figure 2:
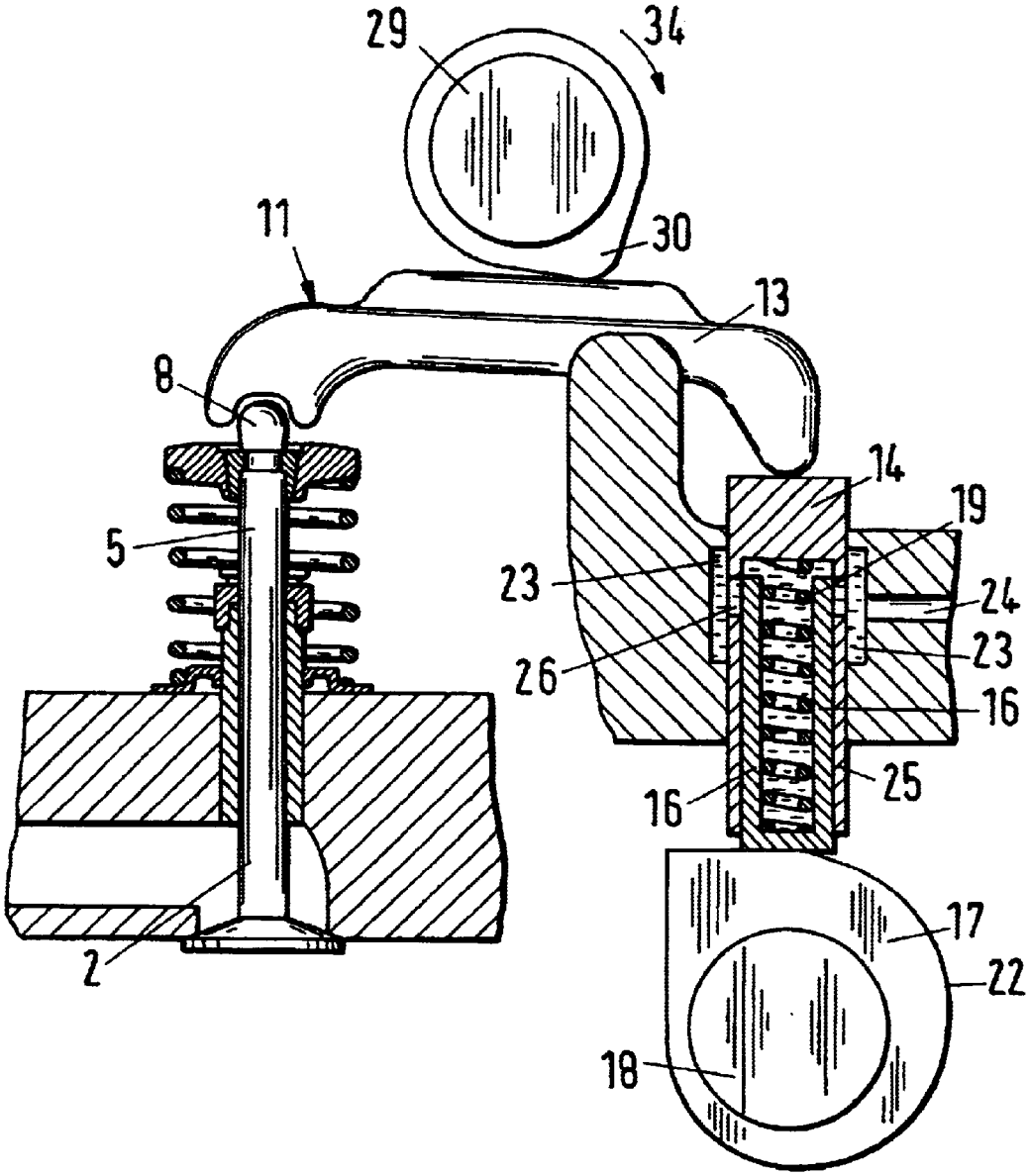
FIG. 2 shows a second position of the valve stroke control according to the present invention.

As shown in FIG. 2, the cam 30 at this point is in the area of the arms 13 of the rocker lever 11. The valve 2 at this point is still in the closed position because the rocker lever 11, when the described rocking movement occurs, is pivoted only about the spherical end 8 of the valve shaft 5.

Figure 3:
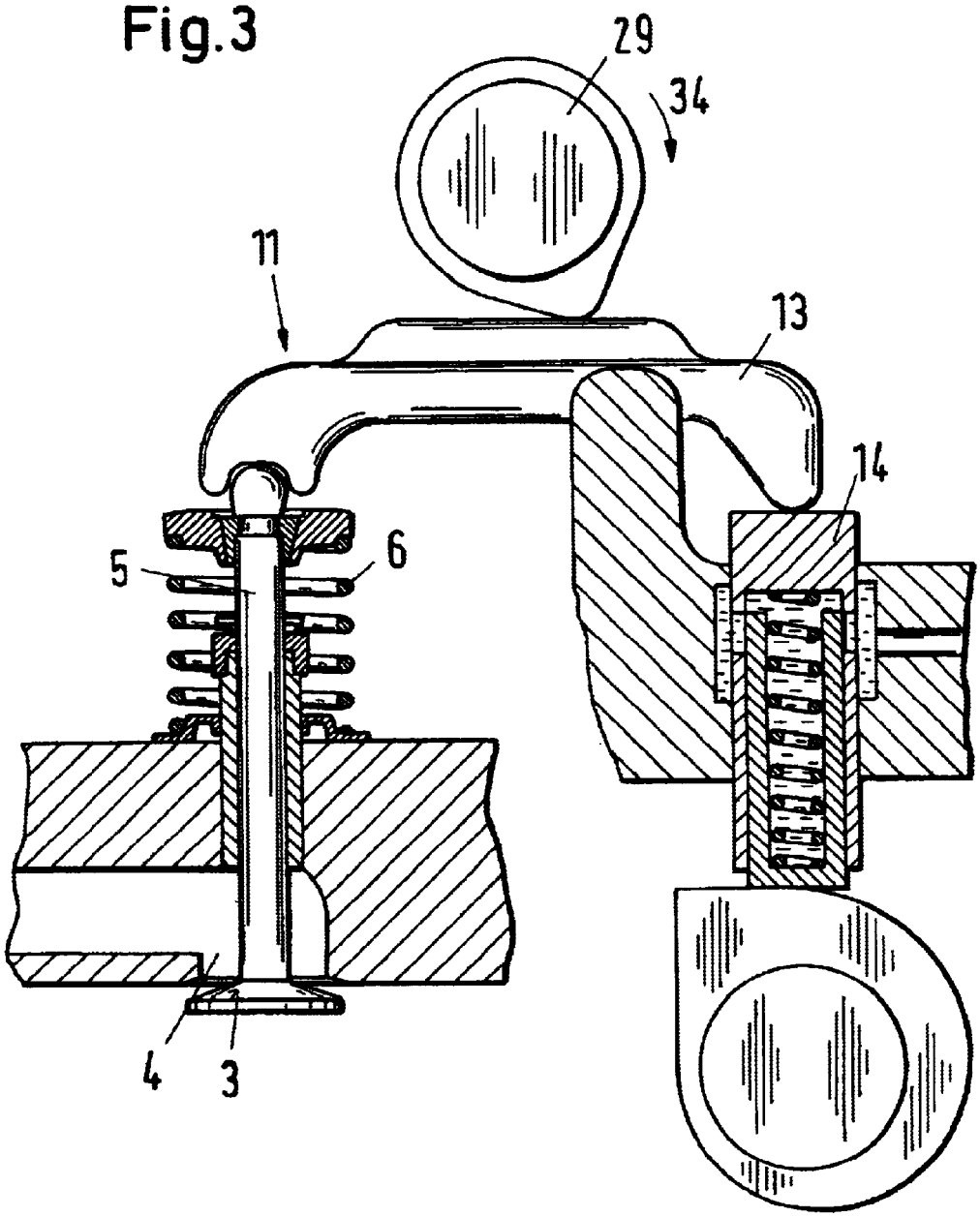
FIG. 3 shows a third position of the valve stroke control according to the present invention.

When the camshaft 29 is rotated from the position according to FIG. 2 farther into the rotary direction 34 (FIG. 3), the rocker lever 11 is pivoted counter to the clockwise direction because the arm 13 of the rocker lever 11 is supported on the adjusting cylinder 14 acting as a fixed bearing. The valve shaft 5 is moved counter to the force of the pressure spring 6 so that the valve disk 3 is lifted off the valve seat and opens the intake opening 4 into the combustion chamber.

Figure 4:
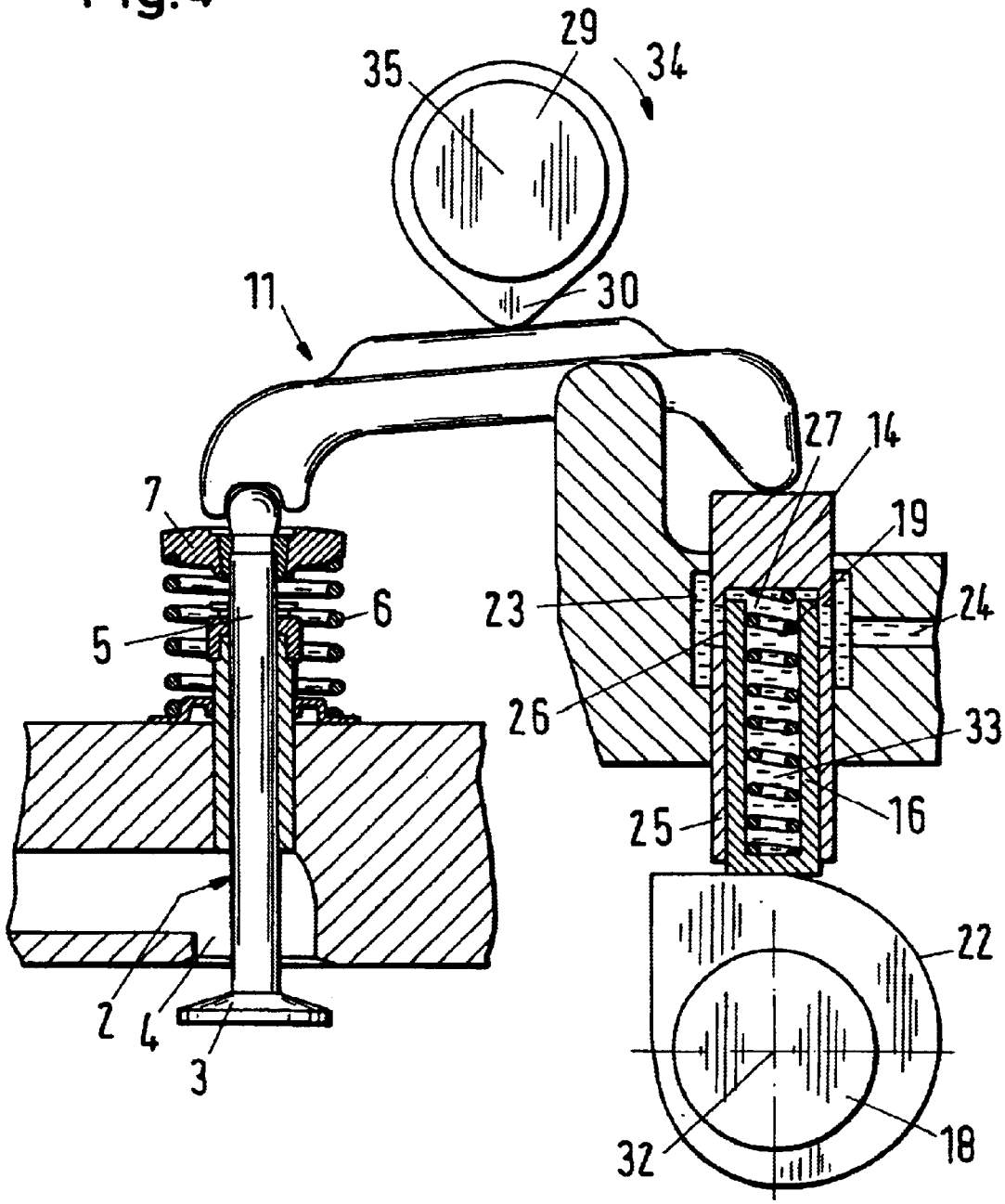
FIG. 4 shows a fourth position of the valve stroke control according to the present invention.

FIG. 4 shows the maximum valve stroke. It is reached when the camshaft 29 has been rotated to such an extent that the cam 30 projects farthest in the direction towards the rocker lever 11. In this position (FIG. 4) the rocker lever 11 has been pivoted farthest counter to the clockwise direction so that the valve shaft 5 is moved farthest. The valve 2 has thus performed the greatest stroke. The valve disk 3 is moved farthest away from the valve seat.

When the camshaft 29 is rotated farther in the direction 34, the rocker lever 11 is pivoted back in the clockwise direction by the valve shaft 5. By means of the spring plate 7, the valve shaft 5 is returned by the pressure spring 6 so that the rocker lever 11 is pivoted by the corresponding amount. The camshaft 29 and the rocker lever 11 finally reach again the position according to FIG. 1 in which the valve 2 closes the intake opening 4 into the combustion chamber. As soon as the valve 2 is closed, the adjusting cylinder 14 is relieved so that the adjusting cylinder 14 is returned by the force of the pressure spring 19 relative to the hollow piston 16. As soon as the hollow piston 16 releases the penetrations or bores 26 in the cylinder wall 25 of the adjusting cylinder 14, the hydraulic medium can flow back via the bore 24 and the annular chamber 23 into the interiors 27, 33 of the adjusting cylinder 14 and of the hollow piston 16. Because the spring chamber between the adjusting cylinder 14 and the hollow piston 16 is enlarged when this occurs, the hydraulic medium is sucked in from the bore 24.

As a result of the described configuration, a valve play compensation is also achieved at the same time so that the valve can be opened and closed reliably.

The force of the pressure spring 19 in the adjusting cylinder 14 is significantly smaller than the force of the pressure spring 6 with which the valve 2 is biased. In any case, the force of the pressure spring 19 is however so large that a safe contact of the adjusting cylinder 14 and of the hollow piston 16 on the rocker lever 11 and on the control curve 22 of the control shaft 18 is ensured.

The relative play between the hollow piston 16 and the adjusting cylinder 14 is so minimal that a sealing function is provided. The hydraulic medium therefore does not reach the exterior so that leakage losses are prevented or are so small that they can be neglected.

Each cylinder of the combustion engine is provided with one lever 11 and the corresponding valve stroke control. On the control shaft 18, depending on the control strategy, several or only one control curve 22 can be provided.

By means of the control shaft 18, the valve stroke can be changed. The valve stroke can be adjusted such that only so much fuel is injected into the corresponding combustion chamber as is required for the momentary output of the combustion engine.

Figure 5:
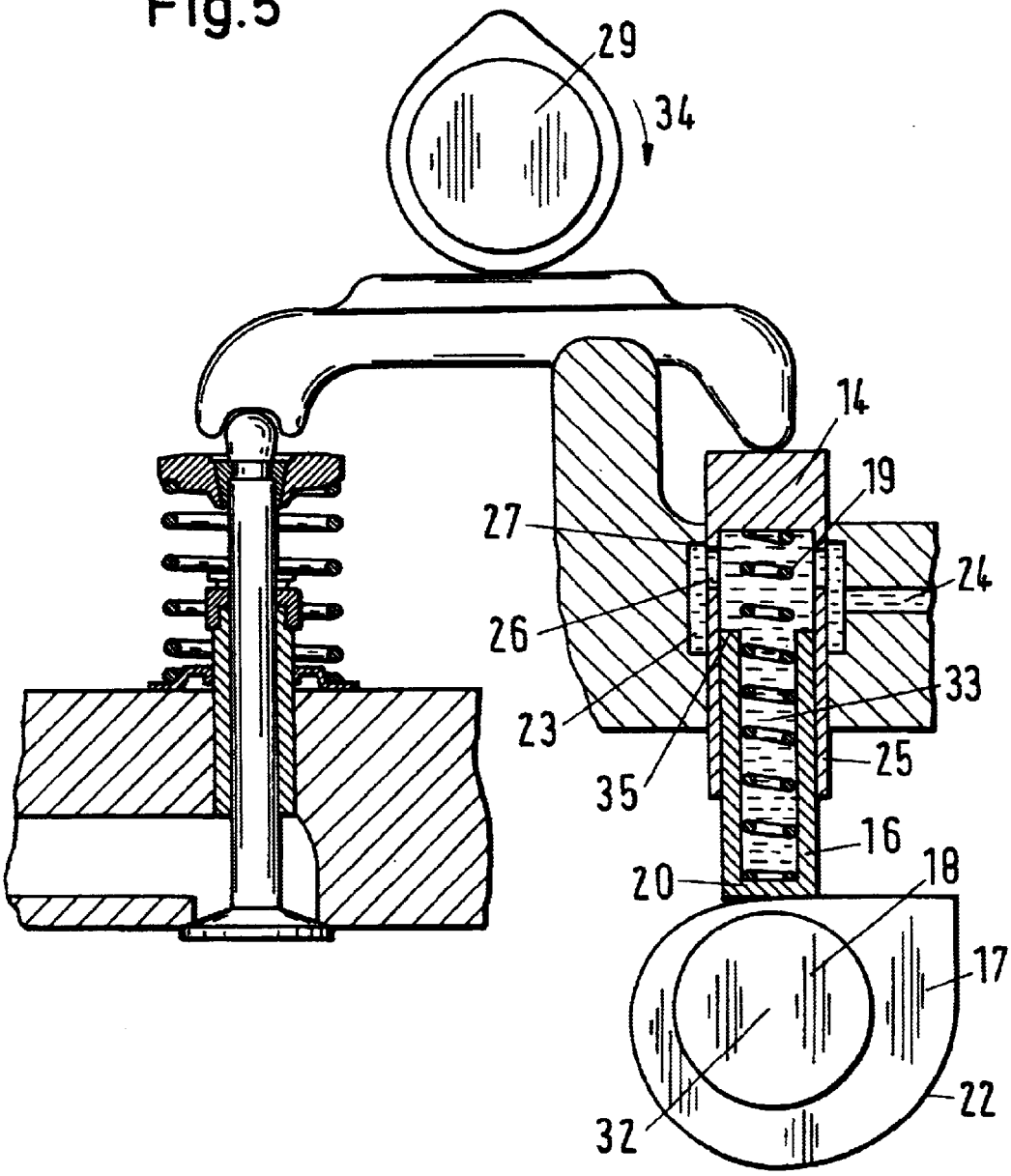
FIG. 5 shows a fifth position of the valve stroke control according to the present invention.
Figure 6:
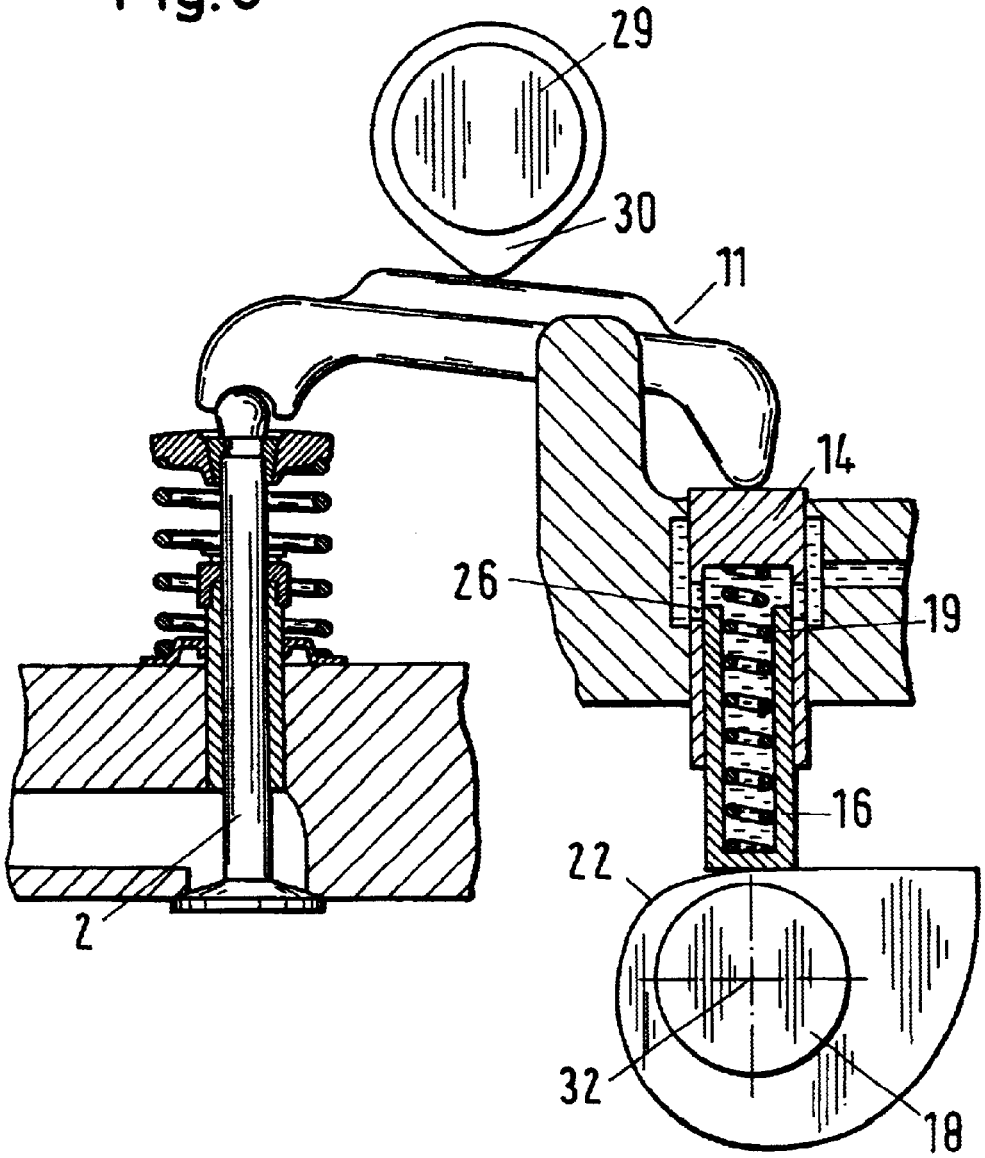
FIG. 6 is a sixth position of the valve stroke control according to the present invention.

By rotating the control shaft 18, the spacing of the hollow piston 16 from the axis 32 of the control shaft 18 can be changed as a function of the rotary position of the control shaft. In FIGS. 1 through 4, the control shaft 18 has been rotated such that the hollow piston 16 has the greatest spacing from the axis 32 of the control shaft 18. FIGS. 5 and 6 show the situation that the hollow piston 16 has the smallest spacing from the axis 32 of the control shaft 18. In this position, the control shaft 18 has been rotated away from the position according to FIGS. 1 through 4 in the clockwise direction until the control shaft 5 has reached the position according to FIGS. 5 and 6. The hollow piston 16 rests with its bottom 20 under the force of the pressure spring 19 against the control curve 22 of the cam 17 of the control shaft 18. The hollow piston 16 has been moved so far out of the adjusting cylinder 14 that the end face 35 of the hollow piston 16 is positioned in the area underneath the penetrations or bores 26 in the cylinder wall 25 of the adjusting cylinder 14. The interiors 27, 33 of the adjusting cylinder 14 and of the hollow piston 16 are thus connected with the annular chamber 23 and the bore 24.

When the camshaft 29 is rotated in the direction 34, the rocker lever 11 is tilted in the clockwise direction, as described in connection with FIGS. 1 through 4, such that the adjusting cylinder 14 is moved relative to the hollow piston 16 against the force of the pressure spring 19. The hollow piston 16 is supported on the control curve 22 of the control shaft 18. Since the control shaft 18 has been rotated such that the spacing between the hollow piston 16 and the axis 32 of the control shall 18 is minimal, the adjusting cylinder 14, in comparison to the position of the control shaft according to FIGS. 1 through 4, is moved significantly farther until the penetrations or bores 26 of the adjusting cylinder 14 are closed by the hollow piston 16. Now the adjusting cylinder 14 and the hollow piston 16 act in the described way as fixed bearings for the rocker lever 11. As a result of the great movement travel of the adjusting cylinder 14 the rocker lever 11 is pivoted to a great extent in the clockwise direction. This has the result that by rotation of the camshaft 29 the valve 2 is not opened at all. As shown in FIG. 6, the cam 30 of the camshaft 29 is in its maximum stroke position without the rocker lever 11 having been pivoted such that the valve 2 is opened. By means of the control shaft 18 it is thus possible to provide a zero stroke for the valve 2.

Depending on the rotary position of the control shaft 18, the stroke of the valve 2 can be adjusted between the maximum stroke (FIGS. 1 through 4) and the zero stroke (FIG. 5 and FIG. 6). When the control shaft 18 is in intermediate positions between the maximum position (FIGS. 1 through 4) and the minimum position (FIGS. 5 and 6), the stroke of the valve 2 can be adjusted continuously between the maximum stroke according to FIGS. 1 through 4 and the zero stroke according to FIGS. 5 and 6. In this way, the amount of fuel to be injected into the combustion chamber for the current output demand of the internal combustion engine can be precisely adjusted in a very simple way.

Figure 7:
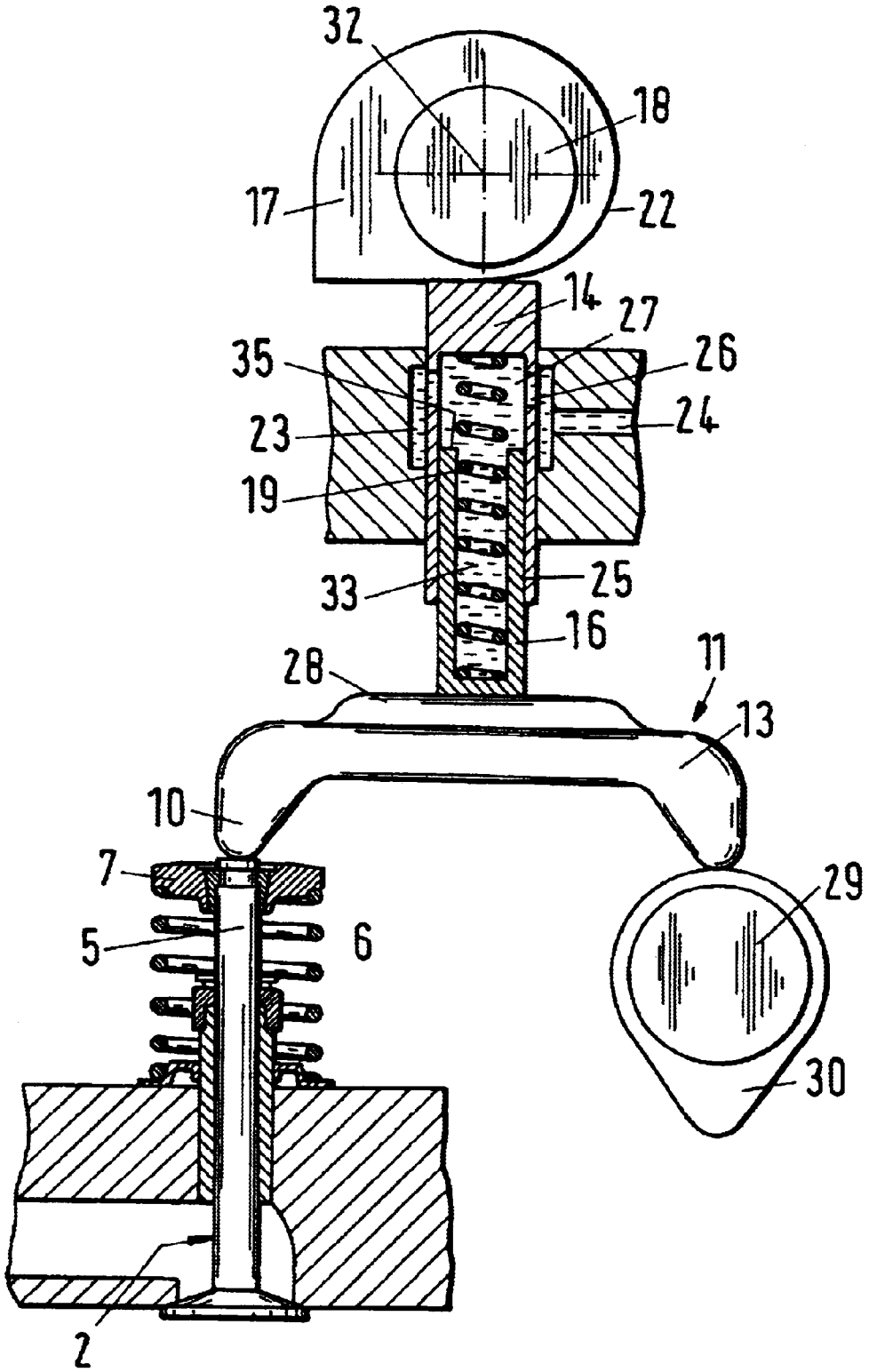
FIG. 7 shows a second embodiment of a valve stroke control according to the invention with the camshaft mounted in the cylinder block.

FIG. 7 shows that the position of the camshaft 29 and control shaft 18 can be exchanged. The function of the valve control does not changed when doing so. The hollow piston 16 is positioned on the projection 28 of the rocker lever 11 under the force of the pressure spring 19. The rocker lever 11 rests with the angled end of its arm 13 against the camshaft 29.

The adjusting cylinder 14 rests against the control curve 22 of the cam 17 of the control shaft 18. It is rotated such that the adjusting cylinder 14 has the smallest spacing from the axis 32 of the control shaft 18. The end face 35 of the hollow piston 16 is positioned at a spacing from the penetrations or bores 26 in the cylinder wall 25 of the adjusting cylinder 14. The penetrations or bores 26 which are provided corresponding to the preceding embodiments closely adjacent to the bottom of the adjusting cylinder 14 are thus not closed by the hollow piston 16. The hydraulic medium can flow from the bore 24 into the annular chamber 23 and from there, by means of the penetrations or bores 26, into the interiors 27 and 33 of the adjusting cylinder 14 and of the hollow piston 16.

When the camshaft 29 rotates, the rocker lever 11 is tilted by the cam 30 first in a counter-clockwise direction wherein the rocker lever 11 is supported with its arm 10 on the end face of the valve shaft 5. Since the force of the pressure spring 6 is greater than the force of the pressure spring 19, the valve shaft 5 is not yet moved upon tilting of the rocker lever 11 by the cam 30 so that the valve 2 cannot be opened during the tilting action. The hollow piston 16 is moved against the force of the pressure spring 19 while the adjusting cylinder 14 is supported on the control curve 22 of the control shaft 18. Upon movement of the hollow piston 16, the interior 27, 33 becomes smaller. The hydraulic medium contained therein is then displaced via the penetrations or bores 26 of the adjusting cylinder 14 and the annular chamber 23 into the bore 24 and back into the hydraulic chamber of the engine. As soon as the hollow piston 16 closes the penetrations or bores 26, the adjusting cylinder 14 and the hollow piston 16 provide a fixed bearing for the rocker lever 11.

This position of the hollow piston 16 is reached according to the preceding embodiments already when the cam 30 of the camshaft 29 has not yet reached its maximum adjusting position in which the cam 30, relative to the position according to FIG. 7, is located on the diametrically opposed side of the camshaft 29. In this way, the rocker lever 11 upon further rotation of the camshaft 29 is tilted in the counter-clockwise direction so that the valve shaft 5 is moved counter to the force of the pressure spring 6 and the valve 2 is opened in this way.

Upon further rotation of the camshaft 29, the valve 2 closes again in that the valve shaft 5 is pushed back by the spring plate 7 by means of the pressure spring 6 acting on it. The rocker lever 11 is tilted in the clockwise direction. As soon as the valve 2 is closed, the cam 30 of the camshaft 29 reaches again such a position that the pressure spring 19 returns the hollow piston 16 and in this way returns the rocker lever 11 into the initial position according to FIG. 7. As soon as the hollow piston 16 releases the penetrations or bores 26 in the adjusting cylinder 14, the hydraulic medium is again sucked in from the bore 24.

In order to change the stroke of the valve 2, the control shaft 18 is rotated.

Depending on the rotary position of the control shaft 18 or its cam 17, the stroke of the valve 2 is changed in a variable way. This achieves that the fuel is injected only in such an amount into the combustion chamber of the internal combustion engine as is required for the momentary output of the internal combustion engine.

The hydraulic medium which is required for the operation of the control device 14, 16 can also be provided in a preloaded storage device. When the hollow piston 16 releases the bores 26 in the adjusting cylinder 14, the hydraulic medium is sucked in from the preloaded storage device. On the other hand, the hydraulic medium can be displaced upon reducing the interiors 27, 33 of the control device 14, 16 back into the storage device.

The circulation of the hydraulic medium in connection with the pre-loaded storage device can be a closed system. However, it is also possible to connect the preloaded storage device by means of a check valve to the motor oil circulation and to supply it to the valve stroke control by means of the motor oil circulation. This provides, in particular, a leakage compensation.

While specific embodiments of the invention have been shown and described in detail to illustrate the inventive principles, it will be understood that the invention may be embodied otherwise without departing from such principles.

What is claimed is:

1. A valve stroke control for an internal combustion engine of a motor vehicle, the valve stroke control comprising:

at least one control device for adjusting a stroke of a valve and configured to interact with at least one camshaft;

at least one control shaft interacting with the at least one control device;

wherein the at least one control device is configured to be actuated by a hydraulic medium;

wherein the at least one control device comprises a first control element and a second control element movable relative to one another;

at least one spring element located between the first and second control elements such that the first and second control elements are movable relative to one another against the force of the at least one spring element.

2. The valve stroke control according to claim 1, wherein the first control element is sleeve-shaped and wherein the second control element is received in the first control element.

3. The valve stroke control according to claim 2, wherein the second control element is a hollow piston.

4. The valve stroke control according to claim 1, wherein the first and second control elements delimit a common hollow interior containing a hydraulic medium.

5. The valve stroke control according to claim 4, further comprising a hydraulic medium source, wherein the hollow interior is connectable to the hydraulic medium source.

6. The valve stroke control according to claim 4, wherein the first control element has at least one connection allowing the hydraulic medium to flow in and out of the hollow interior.

7. The valve stroke control according to claim 6, wherein the at least one connection of the first control element is closable by the second control element.

8. The valve stroke control according to claim 7, wherein the at least one control device is a fixed bearing for a rocker lever when the at least one opening is closed.

9. The valve stroke control according to claim 1, wherein the force of the spring of the first and second control elements is smaller than a spring force biasing the valve into a closed position.

10. The valve stroke control according to claim 1, further comprising a rocker lever adapted to be acted on by the at least one camshaft, wherein the first control element is supported on the rocker lever and wherein the second control element is supported on the at least one control shaft.

11. The valve stroke control according to claim 10, wherein the rocker lever is floatingly supported.

12. The valve stroke control according to claim 10, wherein the rocker lever acts on a valve shaft of the valve.

13. The valve stroke control according to claim 12, wherein the rocker lever is a two-arm lever having a first arm and a second arm.

14. The valve stroke control according to claim 13, wherein the first arm engages the first control element and wherein the second arm is adapted to engage the valve shaft.

15. The valve stroke control according claim 14, wherein the second arm has a cup-shaped receptacle adapted to engage a spherical end of the valve shaft.

16. The stroke control according to claim 10, wherein the rocker lever is adapted to be engaged by the camshaft at approximately half a length of the rocker lever.

17. A valve stroke control for an internal combustion engine of a motor vehicle, the valve stroke control comprising:

at least one control device for adjusting a stroke of a valve and configured to interact with at least one camshaft;

at least one control shaft interacting with the at least one control device;

wherein the at least one control device is configured to the actuated by a hydraulic medium;

wherein the at least one control device comprise a first control element and a second control element movable relative to one another;

a rocker lever adapted to be acted on by the at least one camshaft, wherein the first control element is supported on the rocker lever and wherein the second control element is supported on the at least one control shaft;

wherein the rocker lever has a first arm adapted to engage the camshaft and wherein the second control element engages the rocker lever approximately at half the length of the rocker lever.

18. The valve stroke control according to claim 1, wherein the first and second control elements are adapted to be adjusted relative to one another by the at least one camshaft.

19. The valve stroke control according to claim 1, wherein the hydraulic medium is supplied by an oil circulation of the internal combustion engine.

20. The valve stroke control according to claim 9, further comprising a storage device for the hydraulic medium.

21. The valve stroke control according to claim 20, wherein the storage device is adapted to be connected to an oil circulation of the internal combustion engine by a check valve and is supplied by the motor oil from the oil circulation of the internal combustion engine.

22. The valve stroke control according to claim 1, further comprising a closed hydraulic system comprising a storage device for the hydraulic medium.

23. A value stroke control for an internal combustion engine of a motor vehicle, the valve stroke control comprising:

at least one control device for adjusting a stroke of a valve and configured to interact with at least one camshaft;

at least one control shaft interacting with the at least one control device;

wherein the at least one control device is configured to be actuated by a hydraulic medium;

wherein the at least one control device comprises a first control element and a second control element movable relative to one another;

wherein the first control element is a hollow cylinder comprised of a cylinder bottom and a cylinder wall connected to the cylinder bottom;

wherein the second control element is a hollow piston comprising a piston bottom and a piston wall connected to the piston bottom;

wherein the hallow piston is inserted into the hollow cylinder such that the piston bottom is positioned remote from the cylinder bottom and the piston wall extends from the piston bottom in a direction toward the cylinder bottom and the cylinder wall extends from the cylinder bottom toward the piston bottom;

wherein the hallow cylinder and the hollow piston delimit a common hollow interior containing hydraulic medium;

a pressure spring arranged inside the hollow interior and supported with a first spring end on the piston bottom and with a second spring end on the cylinder bottom:

wherein the cylinder wall has at least one opening;

wherein the at least one opening is closable by the piston wall;

wherein the at least one opening connects the hollow interior to a hydraulic medium source for hydraulic medium.

* * * * *